United States Patent [19]

Hudson

[11] 4,139,253

[45] Feb. 13, 1979

[54] PLUG RETAINING DEVICE

[76] Inventor: Gerald E. Hudson, 229-15th St. West, Billings, Mont. 59102

[21] Appl. No.: 859,948

[22] Filed: Dec. 12, 1977

Related U.S. Application Data

[62] Division of Ser. No. 619,026, Oct. 2, 1975, abandoned.

[51] Int. Cl.[2] ..... H01R 13/56

[52] U.S. Cl. ..... 339/75 P; 339/101

[58] Field of Search ..... 339/75 P, 91 R, 101, 339/106, 123, 119 C

[56] References Cited

U.S. PATENT DOCUMENTS

| | | | |
|---|---|---|---|
| 3,029,408 | 4/1962 | Anderson | 339/75 P |
| 3,383,639 | 5/1968 | Anderson et al. | 339/75 P |
| 3,930,116 | 12/1975 | Richards | 339/123 X |

FOREIGN PATENT DOCUMENTS

| | | | |
|---|---|---|---|
| 818717 | 7/1969 | Canada | 339/75 P |

*Primary Examiner*—Roy Lake
*Assistant Examiner*—E. F. Desmond
*Attorney, Agent, or Firm*—Arthur L. Urban

[57] ABSTRACT

A retaining device for preventing withdrawal of an electric plug from a wall or extension cord socket responsive to forces exerted on a cord connected to the plug. The devices of the first and second embodiments are fastened to a wall adjacent a conventional wall outlet. The devices frictionally engage the cord so that forces exerted on the cord are not transmitted to the plug.

3 Claims, 6 Drawing Figures

FIG. 1
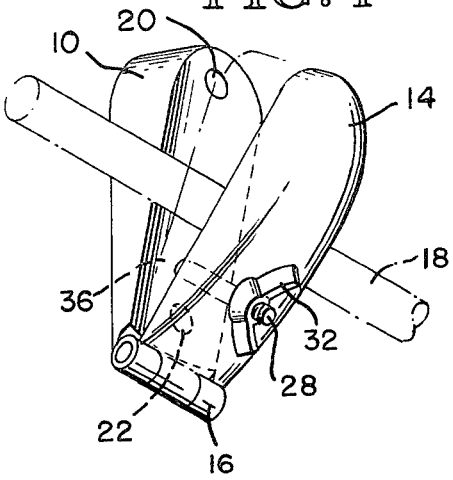
FIG. 2
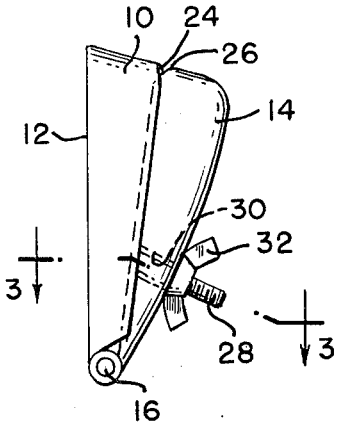
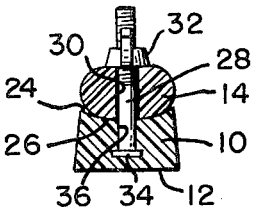
FIG. 3
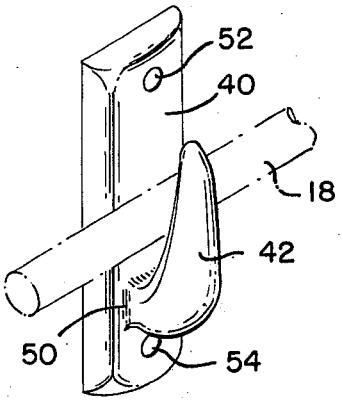
FIG. 4
FIG. 5
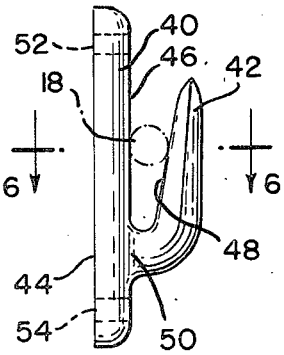
FIG. 6
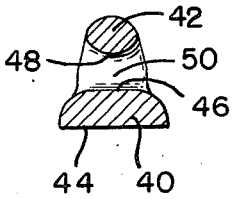

PLUG RETAINING DEVICE

This is a division of application Ser. No. 619,026, filed Oct. 2, 1975 now abandoned.

BACKGROUND OF THE INVENTION

1. Field of the Invention

This invention relates to devices for securing electrical connectors to each other and, more particularly, to devices for preventing disconnection of a plug from conventional wall or extension cord sockets.

2. Description of the Prior Art

Electrical devices are commonly powered through a supply cord terminating in an electrical plug having exposed parallel prongs adapted to be inserted into the recesses of a supply socket. Since many of these electrical devices are somewhat portable, forces are often exerted on the electrical supply cord which may disengage the plug from the socket, strain the prongs of the plug, or damage the cord at the point where the cord meets the plug.

Many attempts have been made in the prior art to overcome the above-described problems. U.S. Pat. No. 2,913,719, issued to Martin, discloses a plug coupling in which a tapered liner member surrounds the cord adjacent the plug, and a tapered shell connected to the outlet is slipped over the liner. Forces exerted on the supply cord cause the shell to compress the liner to prevent relative movement between the cord and shell.

U.S. Pat. Nos. 2,461,427 and 2,720,633, issued to Kneebone and Westberg, respectively, disclose devices for maintaining an electrical connection between a plug and an extension cord socket. However, the device of Kneebone does not prevent damage to the plug prongs; and the device of Westberg does not adequately prevent plug and cord separation since the clamp is resilient, which allows the connectors to be separated by a sufficient force.

SUMMARY OF THE INVENTION

It is an object of this invention to provide a plug retaining device which may be used with a wide variety of plugs and sockets.

It is another object to provide a plug retainer which prevents plug withdrawal even when the supply cord is subjected to stresses of substantial magnitude.

It is still another object to provide a plug retaining device which is compact and easy to use.

These and other objects of the invention are accomplished by a retaining device in which the supply cord or a plug is clamped to a wall or extension socket. Since the device positively, and not resiliently, joins the two connectors, the retaining device is able to withstand greater forces than prior art devices.

BRIEF DESCRIPTION OF THE DRAWINGS

FIG. 1 is an isometric view of the retaining device of the first embodiment frictionally engaging a supply cord.

FIG. 2 is a side elevational view of the retaining device of FIG. 1.

FIG. 3 is a cross-sectional view taken along the line 3—3 of FIG. 2.

FIG. 4 is an isometric view of the retaining device of the second embodiment frictionally engaging a supply cord.

FIG. 5 is a side elevational view of the retaining device of FIG. 4.

FIG. 6 is a cross-sectional view taken along the line 6—6 of FIG. 5.

DETAILED DESCRIPTION OF THE INVENTION

The retaining device of the first embodiment is illustrated in FIGS. 1-3. The device includes an elongated base 10 having a flat surface 12 adapted to abut a stationary member, such as a wall, adjacent a wall outlet. An elongated retaining arm 14 having a length and width approximately equal to those of the base 10 is pivotally secured to the base 10 by a hinge 16. The retaining arm 14 forms an acute angle with the base 10 so that the distance between the base 10 and arm 14 progressively increases away from the area of attachment at the hinge 16. A sufficient area is provided between the base 10 and retaining arm 14 to receive a supply cord 18, illustrated in FIG. 1. A pair of mounting holes 20, 22 are bored through the base 10. Each of the mounting holes 20, 22 receives a threaded fastener, such as a screw or bolt, which engages the stationary member (not shown) abutting the mounting surface 12.

As best illustrated in FIG. 3, the opposed surfaces of the base 10 and retaining arm 14 form respective mating surfaces 24, 26. The mating surface 24 is concave, while the mating surface 26 is correspondingly convex so that the surfaces 24, 26 abut each other. The curved mating surfaces bend the cord 18 into an arcuate shape between the base 10 and retaining arm 14 to bend the cord 18 away from the wall on either side of the retaining device.

The retaining arm 14 is urged toward the base 10 to compress the cord 18 by a screw mechanism including a threaded shaft 28 which extends upwardly from the base 10 past a throughbore 30 in the retaining arm 14 where it is received by a wing nut 32 having a larger diameter than the bore 30. A bolt head 34 formed at the end of the shaft 28 inside the base 10 prevents rotation of the shaft 28 responsive to torque exerted by the wing nut 32. Since the angle between the shaft 28 and the longitudinal axis of the base 10 varies according to the position of the retaining arm 14, the aperture 36 receiving the shaft 28 in the base 10 is elongated along the axis of the base 10 to allow angular movement of the shaft 28.

In operation, the wing nut 32 is rotated counterclockwise to increase the angle between the base and retaining arm 14 to receive the supply cord 18. The plug (not shown) connected to the supply cord 18 is inserted in a wall socket (not shown), and a slight loop is formed in the cord 18 between the retaining device and the plug. The wing nut 32 is then torqued against the arm 14 to force the arm 14 toward the base 10, thereby compressing the cord 18 and frictionally holding it in place. Forces exerted on the supply cord 18 by the electrical device are not imparted to the plug, but are, instead, counteracted by the retaining device.

A second embodiment of the retaining device is illustrated in FIGS. 4–6. The second embodiment includes a base 40 and an integrally formed retaining arm 42 which extends along and away from the base 40. The surface of the base 40 opposite the retaining arm 42 forms a substantially flat mounting surface 44 which abuts a stationary member, such as a wall, adjacent a wall socket. The opposed surfaces of the base 40 and retaining arm 42 form respective mating surfaces 46, 48. The distance between the surfaces 46, 48 progressively increases away from the area of attachment 50 between the base 40 and retaining arm 42. A supply cord 18 connected at one end to a plug (not shown) and at the other end to an electrical device (not shown) is placed between the base 40 and arm 42, and forced toward the area of attachment 50 to compress the cord 18 between the mating surfaces 46, 48 to frictionally maintain the cord 18 in position against forces exerted on the cord 18 by the electrical device. The base 40 is secured to the stationary member by a threaded fastener (not shown), such as a screw or bolt, which is inserted through each mounting hole 52, 56 to engage the stationary member.

The embodiments of the invention in which a particular property or privilege is claimed are defined as follows:

1. A device for retaining a plug within a wall receptacle responsive to forces exerted on an electrical cord connected to said plug, said device comprising: an elongated base having a substantially flat mounting surface; fastening means for securing said base to a stationary member adjacent said wall receptacle, with said mounting surface contacting said stationary member; a frictional retaining arm extending from said base away from said mounting surface to form an acute angle therewith, the surface of said retaining arm adjacent said base being spaced apart from said base by a distance which progressively increases away from the area of attachment between said arm and base such that said cord may be frictionally held between said arm and base; said arm being pivotally secured to said base along an axis perpendicular to the axis of said base and arm such that the angle between said base and arm may be varied; and means for urging said base and arm together to decrease the angle therebetween.

2. The retaining device of claim 1 wherein one of said mating surface is concave and the other of said mating surfaces is convex so that said cord is bent into an arcuate shape between said base and arm.

3. The retaining device of claim 2 wherein said means for urging said base and arm together comprise:

a threaded shaft having one end pivotably but non-rotatably fastened to said base, said shaft extending through an aperture in said arm; and a nut threaded onto said shaft, said nut having a diameter greater than the diameter of said aperture whereby rotation of said nut varies the maximum angle between said base and arm.

* * * * *